US009459057B2

(12) United States Patent
Wand et al.

(10) Patent No.: US 9,459,057 B2
(45) Date of Patent: Oct. 4, 2016

(54) HEAT EXCHANGER

(71) Applicant: ALCOIL USA LLC, York, PA (US)

(72) Inventors: Steven Michael Wand, York, PA (US); James Eric Bogart, Glen Rock, PA (US)

(73) Assignee: Alcoll USA LLC, York, PA (US)

( * ) Notice: Subject to any disclaimer, the term of this patent is extended or adjusted under 35 U.S.C. 154(b) by 521 days.

(21) Appl. No.: 14/160,987

(22) Filed: Jan. 22, 2014

(65) Prior Publication Data

US 2014/0202673 A1 Jul. 24, 2014

Related U.S. Application Data

(60) Provisional application No. 61/756,232, filed on Jan. 24, 2013.

(51) Int. Cl.

| | |
|---|---|
| ***F28F 9/02*** | (2006.01) |
| ***F28D 1/053*** | (2006.01) |
| *F25B 39/02* | (2006.01) |
| *F28D 21/00* | (2006.01) |

(52) U.S. Cl.

CPC ..... *F28F 9/02* (2013.01); *F28D 1/05383* (2013.01); *F28F 9/0273* (2013.01); *F25B 39/028* (2013.01); *F28D 2021/0068* (2013.01); *F28F 9/0214* (2013.01); *F28F 9/0217* (2013.01)

(58) Field of Classification Search

CPC ..... F28F 9/02; F28F 9/0214; F28F 9/0217; F25B 39/02; F25B 39/028

USPC ..... 165/173, 174, 175; 62/515, 525

See application file for complete search history.

(56) References Cited

U.S. PATENT DOCUMENTS 6,564,863 B1 * 5/2003 Martins ..... F28D 1/05383 165/153

6,688,137 B1 2/2004 Gupte (Continued)

FOREIGN PATENT DOCUMENTS

CN 101782297 A 7/2010

EP 1469268 A2 10/2004

(Continued)

*Primary Examiner* — Leonard R Leo

*Assistant Examiner* — Gustavo Hincapie Serna

(74) *Attorney, Agent, or Firm* — McNees Wallace & Nurick LLC

(57) ABSTRACT

A heat exchanger for use with a two-phase refrigerant includes an inlet header, an outlet header, and a plurality of refrigerant tubes hydraulically connecting the headers. A distributor tube has a plurality of orifices disposed in the inlet header, the end of the refrigerant tubes opposite the outlet header extends inside the inlet header and abuts a surface of the distributor tube, a portion of an inner surface of the inlet header facing the surface of the distributor tube and the surface of the distributor tube defining a first chamber. A gap separates at least a portion of the distributor tube and the inlet header, the gap extending from at least the orifices to the first chamber, wherein at least one partition having at least one opening formed therethrough spanning the gap, the partition separating the orifices from the first chamber.

20 Claims, 11 Drawing Sheets

(56) References Cited

U.S. PATENT DOCUMENTS

| | | | | |
|---|---|---|---|---|
| 6,688,138 | B2 * | 2/2004 | DiFlora | F28F 9/028 62/509 |
| 7,143,605 | B2 | 12/2006 | Rohrer et al. | |
| 7,275,394 | B2 * | 10/2007 | Lundberg | F28D 1/05391 165/DIG. 483 |
| 7,562,697 | B2 * | 7/2009 | Gorbounov | F25B 39/028 165/174 |
| 2007/0062679 | A1 * | 3/2007 | Agee | F28F 9/02 165/158 |
| 2009/0000327 | A1 | 1/2009 | Burk et al. | |
| 2011/0017438 | A1 * | 1/2011 | Huazhao | F25B 39/028 165/174 |
| 2011/0061844 | A1 * | 3/2011 | Jianlong | F28D 1/053 165/173 |
| 2011/0290465 | A1 | 12/2011 | Joshi et al. | |
| 2012/0267086 | A1 * | 10/2012 | Yanik | F25B 39/00 165/174 |

FOREIGN PATENT DOCUMENTS

| | | | |
|---|---|---|---|
| WO | 2006043864 | A1 | 4/2006 |
| WO | 2009002256 | A1 | 12/2008 |
| WO | 2012006073 | A2 | 1/2012 |

* cited by examiner

HEAT EXCHANGER

FIELD OF THE DISCLOSURE

The present disclosure relates to heat exchangers usable for HVAC&R systems. More specifically, the present disclosure relates to heat exchangers for use with Microchannel or multi channel or refrigerant tubes.

BACKGROUND OF THE DISCLOSURE

Heat Exchangers used for two phase refrigerant evaporation for air cooling and/or dehumidification of air or gases, such as with heating, ventilation, air conditioning and refrigeration (HVAC&R) systems have historically encountered formidable challenges, requiring customized designs to be configured to operate properly, while achieving acceptable thermal performance while preventing adverse operating conditions such as oil logging, unstable operation, part load operation inefficiencies, liquid pass-through that damages compressors, and other undesirable conditions. In a known heat exchanger 10 having traditional fin and tube evaporator coils or tubes, as shown in FIG. 1, a refrigerant distributor 12 with feeder tubes 14 is used to provide refrigerant into individual or groups of tubes 16 in the coil. Refrigerant velocities, size, and/or enhancement of tubes 16, overall pressure drop in tubes 16, in combination with distributor 12 comprised of feeder tubes 14 are provided in an attempt to achieve equal or sufficient refrigerant distribution into heat exchanger 10, prevent oil drop out or oil logging, prevent refrigerant logging and surging, despite operating in adverse operating conditions. A control valve (not shown), controls the amount of refrigerant injected into heat exchanger 10 based on evaporator temperature, pressure and/or superheated refrigerant 20 exiting heat exchanger 10 via an outlet 22 of a refrigerant outlet header 24.

A stacked, brazed plate heat exchanger 26, typically used as a refrigerant evaporator for fluid cooling is generally depicted in FIGS. 2 and 3. Embossed plates 28 are stacked, with adjacent plates defining a fluid channel for flow of refrigerant 20 such that every other fluid channel between a refrigerant inlet 34 and a refrigerant outlet 36 becomes a refrigerant channel for cooling a fluid 30 flowing through a corresponding fluid channel between a fluid inlet 38 and a fluid outlet 40. A refrigerant distribution tube or distributor tube 32 is then inserted into refrigerant inlet 34. Distributor tube 32 has orifices positioned along a lower portion of distributor tube 32 and pointed downward in a direction substantially opposite a primary flow direction 44 (FIGS. 2 and 4) of refrigerant 20 such that refrigerant 20 is discharged from refrigerant distributor tube 32 from orifices 42 in an initial flow direction 46 prior to turning and flowing in primary flow direction 44. This distributor tube construction for brazed plate heat exchangers has been sold in the United States since the early 1990's.

FIG. 4 is based from an actual photograph showing a cross section taken along line 4-4 of FIG. 3 of the lower section of plate heat exchanger 26, showing refrigerant inlet 34 and fluid outlet 40. Shown together are refrigerant inlet 34, distributor tube 32 with 0.08 inch (2 mm) orifices 42, and plate channels 48. When operating, refrigerant 20 enters refrigerant inlet 34 and proceeds interior of distributor tube 32, the refrigerant flow being metered or controlled through orifices 42 and entering heat exchanger channels 48 formed between alternating adjacent plates 28. Upon entering the heat exchanger channels 48, the initial refrigerant flow direction 46 (FIG. 2) is turned in a direction substantially primary opposite flow direction 44 to flow into plate channels 48 along a heat transfer surface 39 toward refrigerant outlet 36 (FIG. 2). FIG. 4 shows a gap 50 between plate port opening 52 and outer diameter 54 of distributor tube 32. In a later version, outer diameter 54 of distributor tube 32 tightly fits inside plate port opening 52. Orifices 42 are typically positioned at a 6 o'clock or 5 o'clock orientation relative to the direction of primary refrigerant flow direction 44 (12 o'clock orientation).

Other innovations in brazed plates included recessed features punched into the plates or plate ports. Another innovation used a tube of sintered metal which, when inserted into the refrigerant inlet of the plate stack, provided atomization, with limited success. While heat exchanger arrangements utilizing tubes have improved refrigerant distribution, multiple challenges remain. These challenges include oil drop-out at full and part load, inconsistent or below expected performance at part load, operational stability, and limitations associated with refrigerant injection, which limits the number of plates or depth that can be effectively used in a plate heat exchanger.

The development of flat tubes with ultra small multiport openings, also called Microchannel tubes, as are known in the art, when configured as a heat exchanger evaporator used for cooling air (gas) in an air cooling or dehumidifying system, offering opportunities for improved operational efficiencies. However, complexities and issues involving refrigerant distribution and optimal coil performance are many and need to be resolved. These complex issues and phenomenon include, but are not limited to:

- effects of entrance velocity of the refrigerant to be cooled;
- liquid to gas ratio at inlet;
- orifice pressure drop along the inlet manifold;
- vertical re-direction of refrigerant upward to the multiport tubes;
- lateral re-direction of refrigerant flow to a large number of multiple parallel tubes;
- refrigerant liquid dropout and liquid/gas recombination;
- liquid/gas separation;
- vertical flow and effects of gravity;
- effects of manifold header length or depth;
- secondary mal-distribution of refrigerant into the multiport tubes,
- compressor oil drop out;
- oil pass-through and pooling;
- minimum refrigerant velocities;
- outlet header dynamics and pressure drop;
- refrigeration system operation from 100% capacity to 10% capacity;
- minimal refrigerant charge requirements; and
- consideration of refrigerant type characteristics, such as R410a (high pressure, low volumetric gas) versus R134a (low pressure, high volumetric gas).

U.S. Pat. No. 7,143,605 is directed to improve refrigerant distribution for Microchannel tubular heat exchangers. Although U.S. Pat. No. 7,143,605 utilizes previously known prior art and geometries similar to the tubular distributor used in brazed plate heat exchangers previously described, this patent also suffers from several technical deficiencies and omissions. In actual practice and observation, these deficiencies are confirmed in brazed plate heat exchangers and confirmed in Microchannel tubular heat exchangers as identified below.

Other methods attempted for use with heat exchangers having tubes or plates, such as U.S. Pat. No. 6,688,137, relate to direct feed tube injection into the headers and refrigerant recirculation. Such methods all have tried to induce and improve the distribution feed of the entering liquid and gas combination of refrigerant, but most solutions have limited functionality or range of operation, or single design point operation.

Through visual observation, testing, and desired design attributes for an air to evaporating refrigerant heat exchanger, an improved refrigerant distributor of such a heat exchanger is disclosed herein to incorporate novel features and functionality required to efficiently work for Microchannel tubular heat exchangers. The heat exchanger of the present disclosure works in combination with vertical tube orientation and, to work in combination with normal and over-sized manifold headers for optimum thermal performance, and, to counteract the effects of outlet header manifold pressure drop and, to provide uniform refrigerant distribution in the inlet manifold and, to provide uniform injection across all the multiport tubes, over a wide range of operating conditions and design issues. In addition, the heat exchanger of this disclosure will work at any Microchannel tube or refrigerant tube orientation between vertical and horizontal as an evaporator or condenser.

The distributor of the present disclosure can also be operated in reverse refrigerant flow for heating duty in a refrigerant heat pump system, and by using standard automatic switching valves that allow the same evaporator heat exchanger to then be used as a condenser for heating operation.

In addition, the distributor of the present disclosure can be applied to historical Microchannel heat exchanger configurations with round header manifolds (FIGS. 18-21) and non-round header manifolds.

The operation of the heat exchanger of the present disclosure differs from the brazed plate type heat exchanger. In the brazed plate heat exchanger, the refrigerant, after passing through the distributor ports, directly enters the heat transfer surface which promotes refrigerant boiling, creation of gas to propel the refrigerant upward into the plate structure. Whereas, in one embodiment of the heat exchanger of the present disclosure, the refrigerant must pass through the distributor orifices, be directed to the tube area, where each tube is isolated from the adjoining tube, and, the refrigerant is then injected into the tube entrance areas, and where a second refrigerant distribution characteristic is accommodated.

The heat exchanger of the present disclosure differs significantly from U.S. Pat. No. 7,143,605 and the other known art in many ways, including features achieving a deliberate gas/liquid separation of fluid delivered to the distributor, use of a weir arrangement to facilitate refrigerant liquid injection into orifices formed in the distributor, directional control of the refrigerant flow to the inlet or inlet header and then to the Microchannel or multiport tubes or refrigerant tubes, use of secondary openings to create a pressure drop to propel the refrigerant and to spread out the liquid substantially evenly across the length of the header, a ternary set of openings to inject refrigerant into the tube chamber(s), isolation of each tube as mini-chambers or secondary chambers to prevent refrigerant flow between refrigerant tubes prior to entering the tubes, the use of a surface geometry or surface features for holding and capturing refrigerant liquid so as to feed the multiport tube(s) or refrigerant tubes, and method of modifying the tube entrance to alter the refrigerant distribution into the multiport tube or refrigerant tube.

SUMMARY OF THE DISCLOSURE

One embodiment of the disclosure is a heat exchanger for use with a two-phase refrigerant includes an inlet header and an outlet header spaced from the inlet header. A plurality of refrigerant tubes hydraulically connects the inlet header to the outlet header. A distributor tube having a plurality of orifices is disposed in the inlet header, the end of the refrigerant tubes opposite the outlet header extending inside the inlet header and abutting a surface of the distributor tube. A portion of an inner surface of the inlet header faces the surface of the distributor tube and the surface of the distributor tube defining a first chamber. A gap of between about 0.01 inch and about 0.3 inch separates at least a portion of the distributor tube and the inlet header. The gap extends from at least the orifices to the first chamber. At least one partition having at least one opening formed therethrough spanning the gap, the partition separating the orifices from the first chamber.

Another embodiment of the disclosure is a heat exchanger for use with a two-phase refrigerant includes an inlet header and an outlet header spaced from the inlet header. A plurality of refrigerant tubes hydraulically connects the inlet header to the outlet header. A distributor tube having a plurality of orifices is disposed in the inlet header, the end of the refrigerant tubes opposite the outlet header extending inside the inlet header and abutting a surface of the distributor tube. A portion of an inner surface of the inlet header facing the surface of the distributor refrigerator tubes and the surface of the distributor tube defining a first chamber. The surface of the distributor tube has surface features for holding and capturing refrigerant liquid such that each opening formed in the refrigerant tubes forming a secondary chamber therewith. A gap of between about 0.01 inch and about 0.3 inch separates at least a portion of the distributor tube and the inlet header, the gap extending from at least the orifices to the first chamber. At least one partition has at least one opening formed therethrough spanning the gap, the partition separating the orifices from the first chamber.

DESCRIPTION OF THE DISCLOSURE

Embodiments of the heat exchanger of this disclosure have mechanical attributes which create uniform refrigerant distribution and injection into multiport Microchannel tubes or multiport tubes or refrigerant tubes and the like, and more specifically into openings formed in each of the refrigerant tubes, and creates specific heat exchanger characteristics, for the purpose of operating the heat exchanger as an evaporator or as a condenser in a refrigerant based system. Although complexities of behavior associated with heat exchanger operation are not fully understood, a general description of operation believed to be occurring is provided to explain the mechanical features and innovations.

Figure 7:
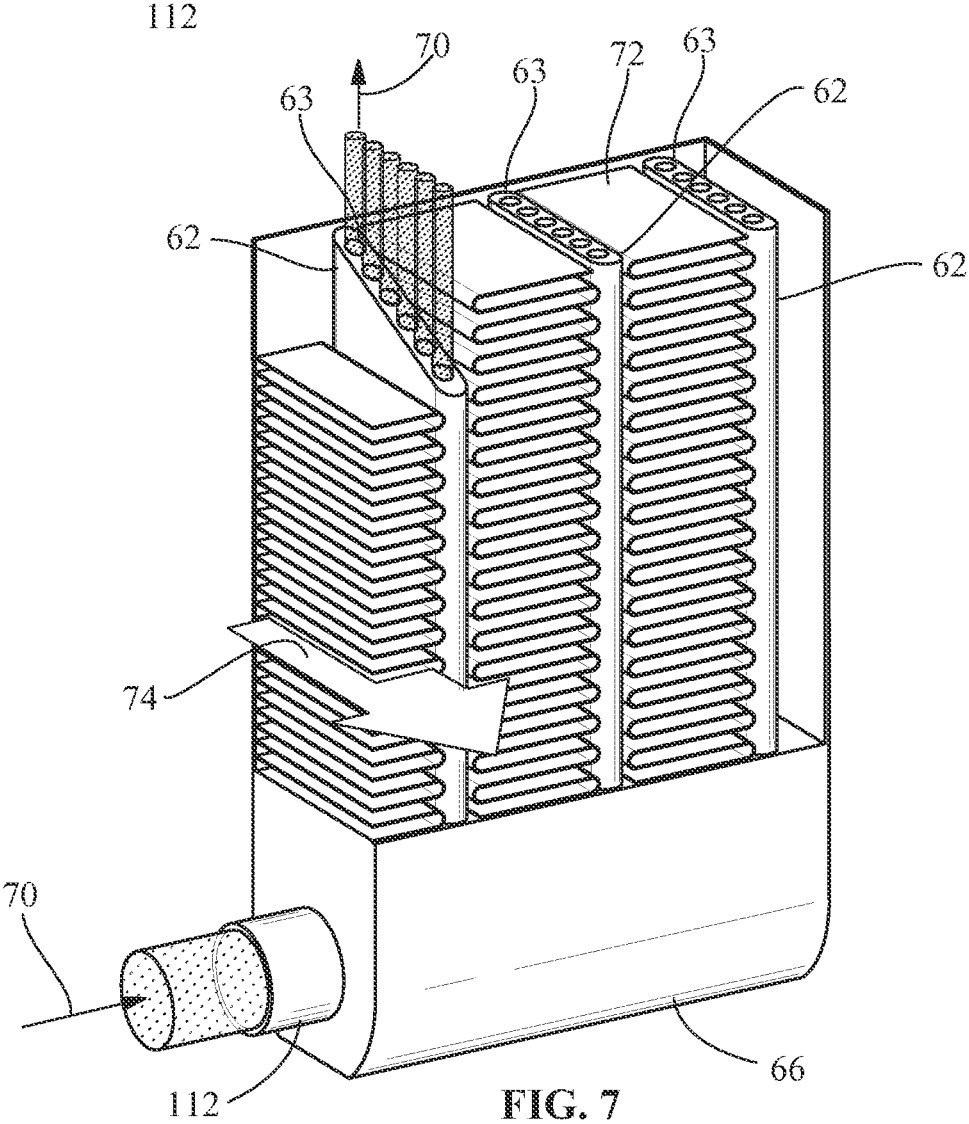
FIG. 7 is a partial cutaway view of the heat exchanger of FIG. 5.

As an evaporator, heat exchanger 60 is comprised of multiple Microchannel, multiport tubes or plurality of refrigerant tubes or refrigerant tubes 62. Each refrigerant tube 62 includes at least one opening 63 formed therein, with an upper outlet manifold header or outlet header 64 and a lower inlet manifold header or inlet header 66 hydraulically connected to each refrigerant tube 62. Inlet header 66 receives a refrigerant distributor or distributor tube 68 having a built-in refrigerant distributor, as shown collectively in FIGS. 5-10 of inlet header 66 into which a refrigerant distributor or distributor tube 68 is received. A combination of these components and/or features substantially comprises the heat exchanger of this disclosure, including special features of refrigerant distributor tube 68 in the lower header or inlet header 66. Two phase refrigerant 70 gas/liquid enters an inlet connection or inlet, then enters the lower heat exchanger manifold or inlet header 66, which contains the novel distributor tube 68. The two phase refrigerant 70 is progressively expanded in the distributor tube 68 to the multiport tubes 62, where the refrigerant 70 enters and begins boiling and evaporating in the tubes 62 create a cooling effect to cool air 74 (FIG. 7) or gas passing through the external fins 72 that are integrally brazed and thermally conducting heat from the air 74 to the tubes 62. The two phase refrigerant 70 boils until only superheated gas 76 remains and travels out of tubes 62 into upper header or outlet header 64 (FIG. 5), where gas 76 is then directed to outlet 78 of heat exchanger 60. Thermal control of the heat exchanger 60 is accomplished by a typical industry control valve (not shown) which regulates the amount of refrigerant 70 entering the heat exchanger 60 based on superheat temperature, pressure or other operating parameter of the refrigerant or other parameter or operation condition of an HVAC&R system.

Figure 10:
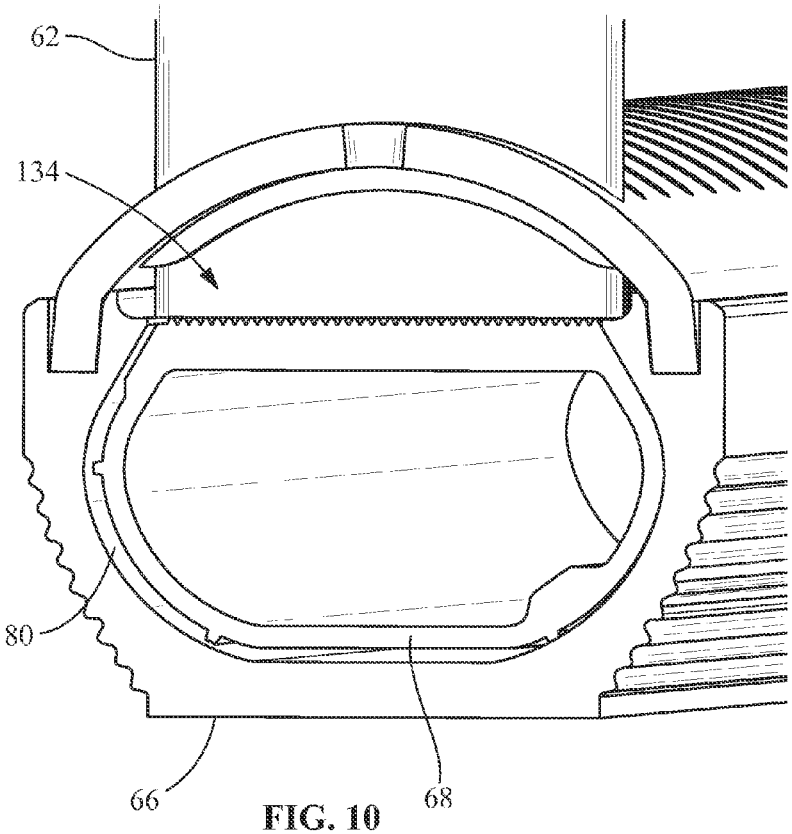
FIG. 10 is an enlarged partial perspective view of the inlet header of FIG. 9.
Figure 11:
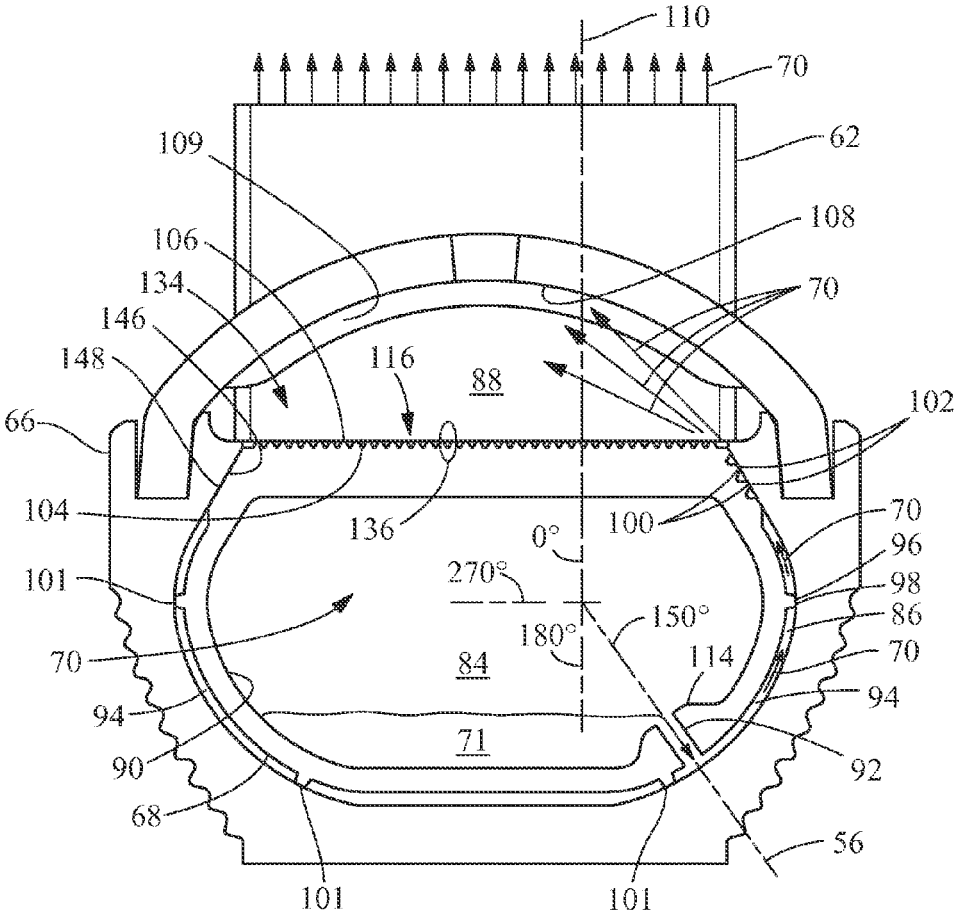
FIG. 11 is an enlarged end view of the inlet header of FIG. 9.

As shown in FIG. 10, lower manifold or inlet header 66 comprises a round or non-round chamber 80, in which a second tube, such as an extrusion (herein referred to as the distributor or distributor tube 68 is nested. As shown in FIG. 11, distributor tube 68 creates three chambers 84, 86 88 in which the two phase refrigerant 70 enters chamber 84 defined by inner surface 90 of distributor tube 68 (chamber 86), and then is forcibly directed or injected through a plurality of orifices 92 into a chamber 86 located in a gap 94 between or separating the manifold or inlet header 64 and distributor tube 68. Refrigerant 70 travels along gap 94 between distributor tube 68 and manifold or inlet header 66 and passes through a tab or partition 96 spanning gap 94. As further shown in FIGS. 11 and 15, partition 96 has a plurality of openings 98 formed therethrough and then through a plurality of openings 102 formed in a corresponding plurality of partitions 100 spanning gap 94. At the plurality of openings 102, the refrigerant 70 is injected into chamber 88 which contains an entrance area for one end of the Microchannel tubes or refrigerator tubes 62, whereby two phase refrigerant 70 can be forcibly directed or injected into the refrigerator tubes 62. Stated another way, end 104 of the refrigerant tubes 62 positioned opposite the outlet header 64 extends through a slot 142 having opposed flanges 109 (FIG. 17) for receiving refrigerant tubes 62 inside the inlet header 66 and abuts a surface 106 of the distributor tube 68, a portion of an inner surface 108 of the inlet header 66 facing surface 106 of distributor tube 68 and surface 106 of distributor tube 68 defining chamber 88. Although exemplary embodiments show tubes or partitions 96, 100 extending outwardly from the distributor tube 68, one or more of partitions can extend inwardly from the inlet header 66.

An exemplary distributor tube 68 of this disclosure is typically the maximum or optimum inside diameter (or cross sectional area if inlet header 66 is non-circular) that can be received by inlet header 66, thereby creating a large entrance chamber 84. This increased cross sectional area allows for a combination of low and high refrigerant inlet velocities and accommodates changing characteristics of the refrigerant distribution profile inside distributor tube 68. The cross sectional diameter (or area) of chamber 84 or defined by inner surface 90 of distributor tube 68 can range from about a multiple of one or one times (1×) the cross sectional area of inlet connection 112, to preferably a larger cross section area, up to 5× or larger. In other words, in one embodiment, a ratio of cross sectional area of distributor tube 68 defined by inner surface 90 to the cross sectional ratio defined by inner surface 90 of inlet connection 112 is greater than about 5:1; greater than about 4:1; greater than about 3:1; between about 1:1 to about 5:1; between about 2:1 to about 5:1; between about 3:1 to about 5:1; between about 4:1 to about 5:1; is about 1:1; is about 2:1; is about 3:1; is about 4:1; is about 5:1, or any suitable subrange thereof. This oversized distributor tube 68 has demonstrated an ability to utilize atomized refrigerant entering distributor tube 68, but also induces refrigerant liquid and gas separation, allowing entering liquid refrigerant 71 to puddle (FIG. 11), such as by gravity in the lower portion of distributor tube 68 near orifices 92 while receiving and distributing refrigerant 70 (which includes liquid refrigerant 71) into long manifold inlet headers 66 without mal-distribution issues. The terms manifold header, header manifold, inlet manifold header or inlet header may be interchangeably used.

It is to be understood that flow of refrigerant 70 through or downstream of orifices 92 also includes flow of liquid refrigerant 71, even if not explicitly stated.

Figure 12A:
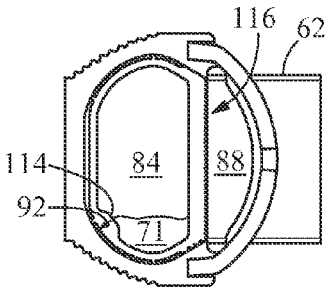
FIGS. 12A, 12B, 12C show the inlet header positioned in three different orientations.
Figure 12B:
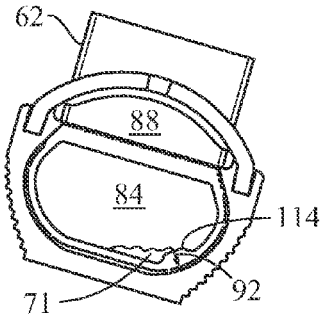
Figure 12C:
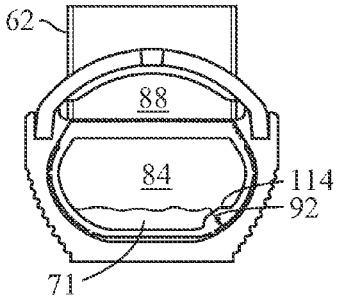
Figure 13:
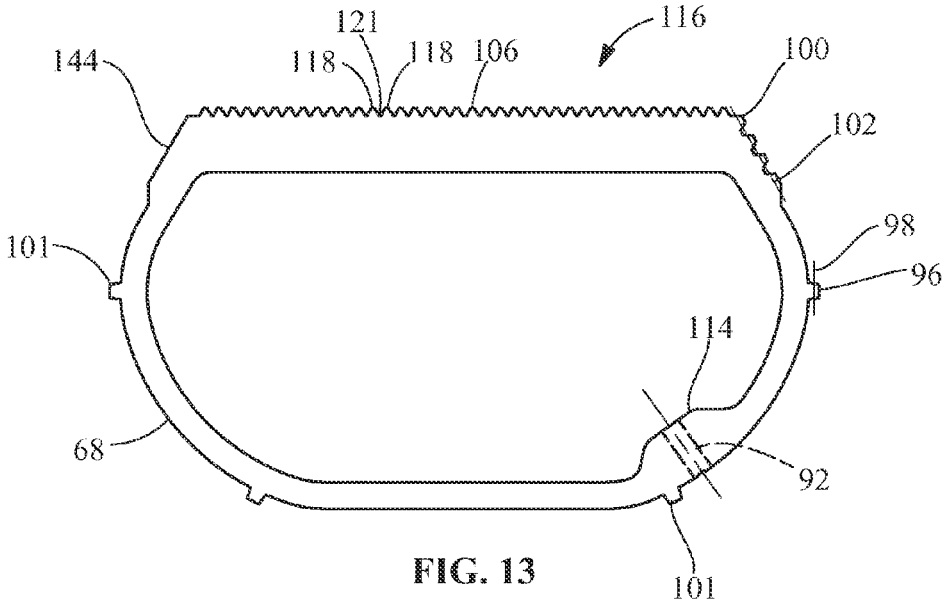
FIG. 13 is an end view of an exemplary distributor for insertion in the inlet header.
Figure 14:
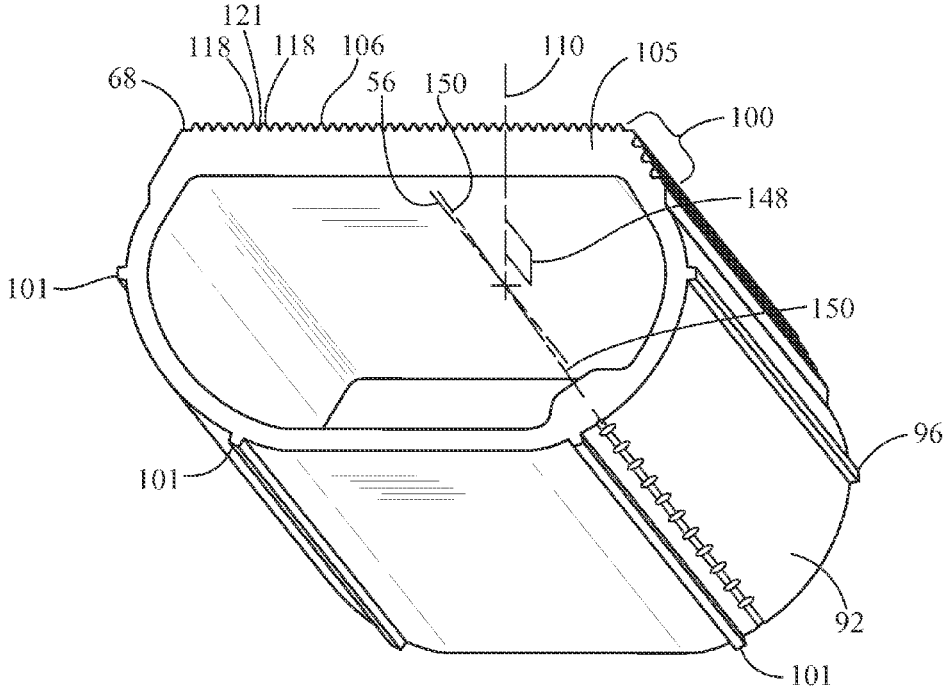
FIG. 14 is a lower perspective view of the distributor of FIG. 13.

Distributor tube 68 then has an outwardly extending region 114, such as a raised ridge (FIGS. 12-13) from an interior wall or inner surface 90 of chamber 84 of distributor tube 68. Orifices formed in or extending through the raised ridge or outwardly extending region 114 of the distributor tube are between about 0.0003 square inch ($in^2$) to about 0.03 square inch ($in^2$) in area, and can be circular (respectively, about 0.02 inch to about 0.2 inch in diameter) or non-circular. (FIGS. 13-14). As further shown in FIGS. 11 and 14, orifices 92 formed in outwardly extending region 114 and having an axis 56 extending through orifices 92 are oriented between about 150 degrees and about 180 degrees relative to an axis 110 that is substantially coincident to a flow direction of refrigerant 70 through the refrigerant tubes 62. Stated another way, orifices 92, as further shown in FIGS. 11 and 14 are substantially aligned with each other. That is, orifices 92, which are coincident with a plane 58, axis 56 and an axis 150 that extends along the longitudinal length of distributor tube 68, subtends an angle of between about 150 degrees and about 180 degrees relative to plane 58 and a plane 148 that is coincident with axes 110 and 150.

These orifices 92 induce a pressure drop of gas and liquid refrigerant 70 (which includes liquid refrigerant 71) when entering a second chamber 86 and improves gas and liquid refrigerant 70 distribution from chamber 84 when the proper range of pressure drop through orifices 92 is used. The raised ridge or outwardly extending region 114 allows all of orifices 92 to be slightly vertically or generally oriented vertically above a puddle of liquid refrigerant 71 (FIGS. 12A, 12B, 12C) that will accumulate in the lower portion of chamber 84, irrespective the orientation of refrigerant tubes between a horizontal position (FIG. 12A) and a vertical position (FIG. 12C), thereby creating a weir effect and allow refrigerant liquid 71 to flow substantially evenly into orifices 92 and into chamber 86, thereby further assuring uniform refrigerant distribution 70 (which includes liquid refrigerant 71) leaving chamber 84. The number of orifices 92 formed in distributor tube 68 can be arranged such that one orifice 92 is operatively associated with one multiport or refrigerant tube 62, one orifice 92 is operatively associated with two refrigerant tubes 62, one orifice 92 is operatively associated with three refrigerant tubes 62, etc., to whatever is desired for pressure drop and orifice to tube (orifice 92 to refrigerant tube 62) ratio desired, and depending also upon the size of orifice 92.

In one embodiment, as shown in FIG. 11, distribution tube 68 is also nested or disposed such that a gap 94 between the at least a portion of inlet header 66 and distributor tube 68 is minimized to about 0.3 inch to about 0.01 inch, thereby creating chamber 86. Control of the dimensions of gap 94 is critical and is achieved by positioning tabs or partitions 96, 100, 101 extending between facing surfaces of distributor tube 68 and inlet header 66. In one embodiment, protruding features, such as tabs or partitions can position distributor tube 68 relative to manifold header or inlet manifold or inlet header 66. One or more of the protruding features or tabs or partitions 96, 100, 101 can extend outwardly from the facing surfaces of the distributor tube and/or manifold header or inlet manifold or inlet header.

In one embodiment, gap 94 is between about 0.01 inch and about 0.02 inch, between about 0.01 inch and about 0.03 inch, between about 0.01 inch and about 0.04 inch, between about 0.01 inch and about 0.05 inch, between about 0.01 inch and about 0.06 inch, between about 0.01 inch and about 0.07 inch, between about 0.01 inch and about 0.08 inch, between about 0.01 inch and about 0.09 inch, between about 0.01 inch and about 0.1 inch, between about 0.01 inch and about 0.15 inch, between about 0.01 inch and about 0.2 inch, between about 0.01 inch and about 0.25 inch, between about 0.01 inch and about 0.3 inch, between about 0.05 inch and about 0.1 inch, between about 0.05 inch and about 0.2 inch, between about 0.05 inch and about 0.25 inch, between about 0.05 inch and about 0.3 inch, between about 0.1 inch and about 0.15 inch, between about 0.1 inch and about 0.2 inch, between about 0.1 inch and about 0.3 inch, between about 0.15 inch and about 0.2 inch, between about 0.15 inch and about 0.25 inch, between about 0.15 inch and about 0.3 inch, between about 0.2 inch and about 0.25 inch, between about 0.2 inch and about 0.3 inch, or any suitable sub-range thereof. In another embodiment, gap 94 is about 0.01 inch, about 0.02 inch, about 0.03 inch, about 0.04 inch, about 0.05 inch, about 0.06 inch, about 0.07 inch, about 0.08 inch, about 0.09 inch, about 0.1 inch, about 0.11 inch, about 0.12 inch, about 0.13 inch, about 0.14 inch, about 0.15 inch, about 0.16 inch, about 0.17 inch, about 0.18 inch, about 0.19 inch, about 0.2 inch, about 0.25 inch, about 0.3 inch, or any suitable sub-range thereof.

As the mixture of liquid and gas refrigerant 70 (which also includes liquid refrigerant 71) collectively enters chamber 86 via the multiple orifices 92 arranged between distributor tube 68 and manifold header or inlet header 66, and due to the narrow passageway or gap 94, the two phase refrigerant 70 will spread out laterally over length of the distributor tube 68 as the refrigerant 70 travels vertically along chamber 86, but not such that refrigerant 70 cannot migrate or flow easily en masse along length of the inlet header 66, achieving substantially uniform flow along the inlet header 66. Gap 94 when properly sized within the above-given range, also assures optimal refrigerant velocity and virtually eliminates drop out or retention of any oil in the refrigerant at this stage over a broad range of operating conditions of the system.

The positioning tabs or partitions 101 in the gap 94 also have a second function in that the positioning tab or partition positioned vertically below and substantially opposite the raised ridge or outwardly extending region 114 and tabs or partitions 101 encountered thereafter in gap 94, tabs or partitions 101 and/or interfacing surfaces 144, 146 opposite chamber 86 (as shown in FIGS. 11, 13-15) will block refrigerant flow in one direction in gap 94, while tab or partition 96 in fluid communication with chamber 86 positioned vertically above the raised ridge or outwardly extending region 114, (as shown in FIGS. 5, 11, 13-15) have at least one opening which allow the two phase refrigerant 70 to pass therethrough, expand and accelerate past the positioning tab or partition 96, and thus the refrigerant 70 is pushed along chamber 86 toward chamber 88 (FIG. 11). In one embodiment, a single opening 98, such as a continuous slot can be formed in tab or partition 96. In one embodiment, a plurality of opening 98, such as a plurality of slots can be formed in tab or partition 96. In one embodiment, more than one tab or partition 96 can be used, each partition 96 having one or more openings 98.

Upon refrigerant 70 passing tabs or partitions 100 and openings 102 formed therein, refrigerant 70 reaches chamber 88. These openings 98, 102 formed in positioning tabs or partitions 96, 100 can be machined, knurled, etched, embossed or formed in any suitable way, or be or include a mesh, sintered metal, wire cloth or other porous or permeable structure, provided that a target pressure drop is achieved. The target pressure drop is related to the type of refrigerant used, the size of the openings 98, 102 and other parameters or values, including the operating conditions of the system. The number of openings 96 formed on the position tab or partitions 96 can be arranged such that one opening 98 is operatively associated with one multiport or refrigerant tube 62, one opening 98 is operatively associated with two multiport or refrigerant tubes 62, one opening 98 is operatively associated with three multiport or refrigerant tubes 62, or higher ratios of openings 98 to the number of multiport or refrigerant tubes 62, but alternately, can also be a lower ratio than one opening 98 to one multiport or refrigerant tube 62. That is, in one embodiment, one opening 98 can be operatively associated with more than one multiport or refrigerant tube 62. Thus, openings 98 on the positioning tabs or partition 96 push refrigerant 70 forward (both vertically and laterally) as the two phase mixture expands through openings 98, and assist in spreading out the two phase refrigerant 70 across the width of inlet header 66.

Figure 18:
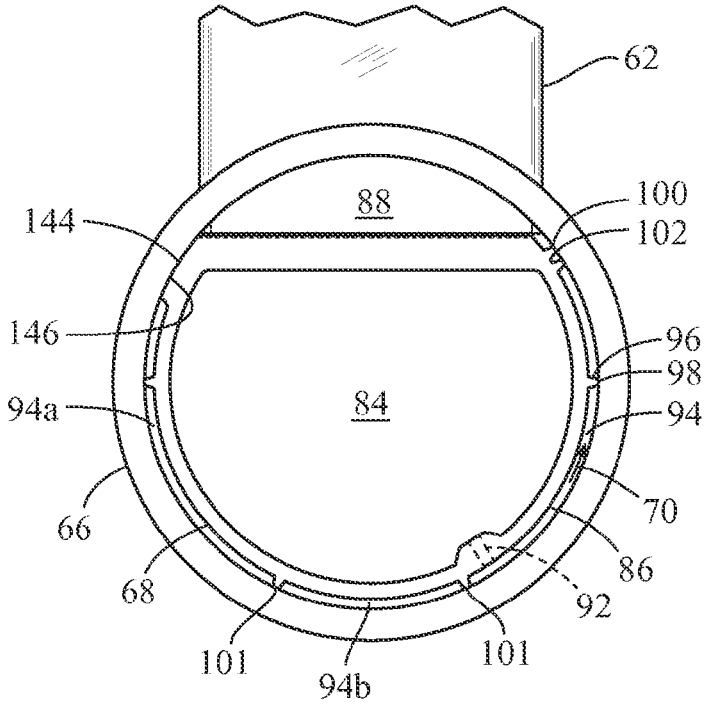
FIGS. 18-21 are different views of an exemplary embodiment of an inlet header.
Figure 19:
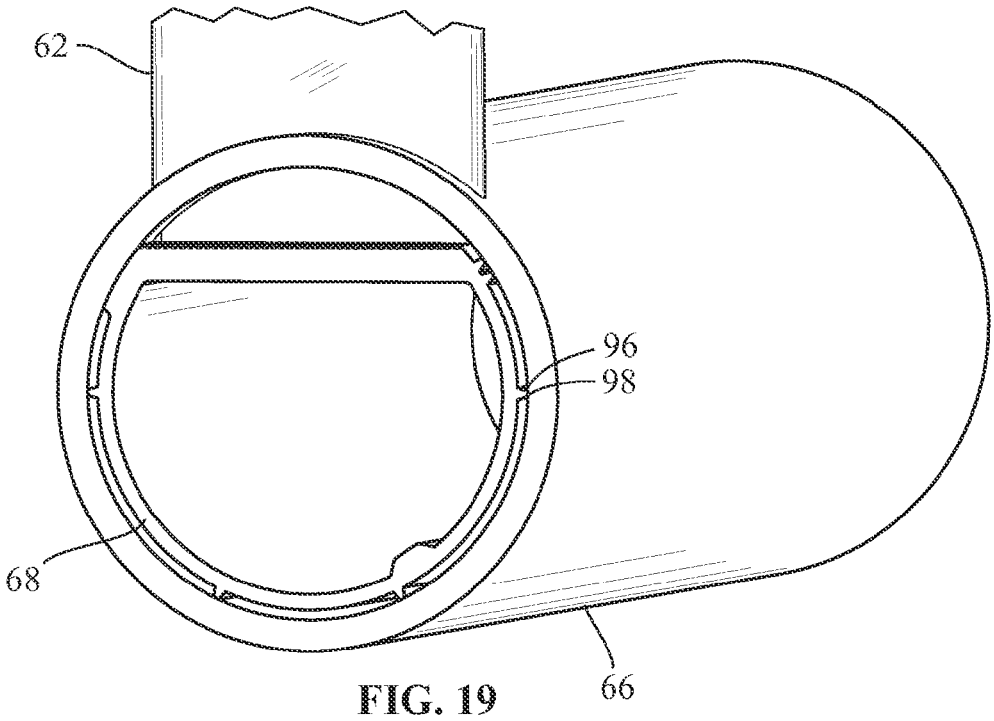
Figure 20:
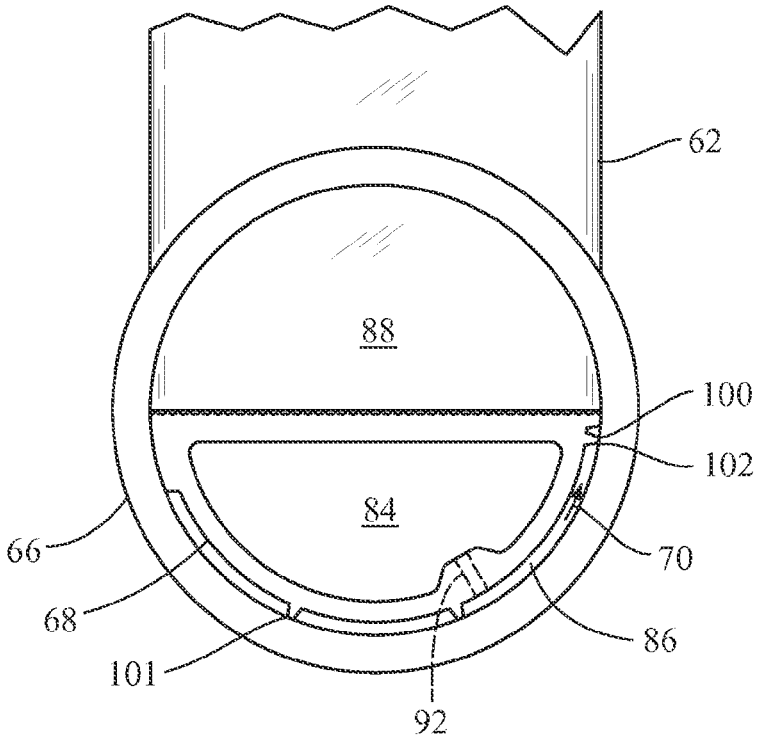
Figure 21:
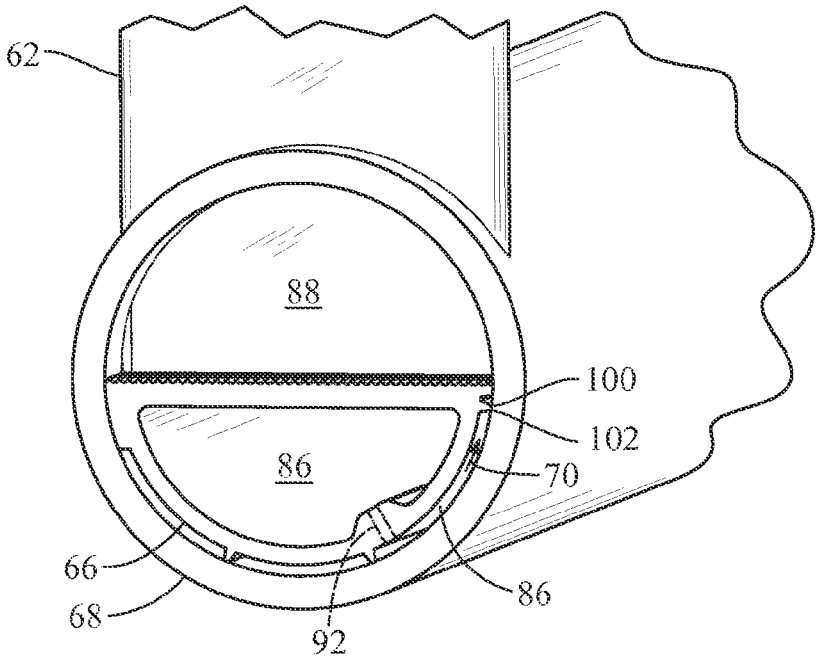

In one embodiment, such as shown in FIG. 18, two phase refrigerant 70 flows through orifices 92 from chamber 84 and into chamber 86 along a portion of gap 94 having a controlled spacing between at least a portion of the facing surfaces of distributor tube 68 and inlet header 66 toward chamber 88. However, refrigerant 70 flowing through orifices 92 from chamber 84 and into chamber 86 is prevented from flowing along gap portions 94*a*, 94*b*, and through one or more of tabs or partitions 101 and interfacing surfaces 144, 146, such that refrigerant 70 is constrained to flow in one direction from orifices 92, through chamber 86 and then into chamber 88. In addition, as further shown in FIGS. 18 and 19, refrigerant 70 encounters one partition 96 having one or more openings 98 and then encounters a pair of partitions 100 having one or more openings 102 prior to refrigerant 70 reaching chamber 88. As further shown in FIGS. 20, 21 which operates in a manner similar to the heat exchanger construction shown in FIGS. 18-19, partition 96 is not used, and only one partition 101 is used. In another embodiment, a single partition having one or more openings positioned in chamber 86 can be used to inject refrigerant from orifices 92 or chamber 84 into chamber 88.

It is to be understood that terms relating to orientation such as above, below etc., are provided for understanding the disclosure and not intended to be limiting.

As shown, a second set of positioning tab(s) or partition(s) 100 (FIG. 11, 13-15) are located in close proximity to and on only one side of the distributor tube 68. These tab(s) or partition(s) 100 also have openings 102 machined, knurled, etched or embossed along the length of tab(s) or partition(s) 100 as well, and/or be a mesh or other suitable porous or permeable structure can be used. The number of openings 102 formed on these last tab(s) or partition(s) 100 can be arranged such that one opening 102 is operatively associated with one multiport or refrigerant tube 62, two opening 102 are operatively associated with one multiport or refrigerant tube 62, three openings 102 are operatively associated with one multiport or refrigerant tube 62, or higher ratios of openings 102 to one multiport or refrigerant tube 62. That is, in one embodiment, more than three openings 102 can be operatively associated with one multiport or refrigerant tube 62. These positioning tab(s) or partition(s) 100 also extend between inlet header 66 and distributor tube 68 and provide a final seal therebetween and an additional set of openings 102 formed in tabs or partitions 100, such that the two phase liquid and gas refrigerant 70 in chamber 86 can be injected into chamber 88, which is in fluid communication with the Microchannel (multiport) or refrigerant tubes 62.

An upper section of distributor tube 68 includes a surface 106 that can be substantially flat and smooth, or, as shown collectively in FIGS. 11 and 13, include surface features 116 such as ridges 118 extending outwardly from surface 106 between about 0.01 inch and about 0.1 inch and between about 0.01 inch and about 0.1 inch between adjacent ridges 118. When ridges 118 are used on substantially flat surface 106, distributor tube 68 operation improves, flow of refrigerant 70 to Microchannel multiport or refrigerant tubes 62 is improved, and oil dropout is also substantially prevented, and allows for close contact interface with Microchannel multiport or refrigerant tubes 62. For purposes herein, close contact interface includes ends of refrigerant tubes 62 in close proximity with and/or abutting ridges 118. With surface features 116 such as ridges 118 arranged on surface 106 of distributor tube 68, the heat exchanger can also be tilted to various angles (FIGS. 12A, 12B, 12C), in that these ridges 118 will impede or slow down liquid refrigerant 71 from dropping to one side or the lower region of chamber 88. With openings 102 located at the bottom, lower position when the heat exchanger is tilted (FIG. 12A), as further shown in FIG. 11, continuous flow of refrigerant 70 from openings 102 will aggressively agitate liquid phase refrigerant of refrigerant 70 collected in chamber 88 such that excess liquid refrigerant will be substantially prevented from accumulating in the lower region of chamber 88 and will be re-entrained and re-injected throughout chamber 88.

In one embodiment, ridges 118 extend outwardly from surface 106 between about 0.01 inch and about 0.02 inch, between about 0.01 inch and about 0.03 inch, between about 0.01 inch and about 0.04 inch, between about 0.01 inch and about 0.05 inch, between about 0.01 inch and about 0.06 inch, between about 0.01 inch and about 0.07 inch, between about 0.01 inch and about 0.08 inch, between about 0.01 inch and about 0.09 inch, between about 0.01 inch and about 0.1 inch, between about 0.02 inch and about 0.03 inch, between about 0.02 inch and about 0.04 inch, between about 0.02 inch and about 0.05 inch, between about 0.02 inch and about 0.06 inch, between about 0.02 inch and about 0.07 inch, between about 0.02 inch and about 0.08 inch, between about 0.02 inch and about 0.09 inch, between about 0.02 inch and about 0.1 inch, between about 0.03 inch and about 0.04 inch, between about 0.03 inch and about 0.05 inch, between about 0.03 inch and about 0.06 inch, between about 0.03 inch and about 0.07 inch, between about 0.03 inch and about 0.08 inch, between about 0.03 inch and about 0.09 inch, between about 0.03 inch and about 0.1 inch, between about 0.04 inch and about 0.05 inch, between about 0.04 inch and about 0.06 inch, between about 0.04 inch and about 0.07 inch, between about 0.04 inch and about 0.08 inch, between about 0.04 inch and about 0.09 inch, between about 0.04 inch and about 0.1 inch, between about 0.05 inch and about 0.06 inch, between about 0.05 inch and about 0.07 inch, between about 0.05 inch and about 0.08 inch, between about 0.05 inch and about 0.09 inch, between about 0.05 inch and about 0.1 inch, between about 0.06 inch and about 0.07 inch, between about 0.06 inch and about 0.08 inch, between about 0.06 inch and about 0.09 inch, between about 0.06 inch and about 0.1 inch, between about 0.07 inch and about 0.08 inch, between about 0.07 inch and about 0.09 inch, between about 0.07 inch and about 0.1 inch, between about 0.08 inch and about 0.09 inch, between about 0.08 inch and about 0.1 inch, between about 0.09 inch and about 0.1 inch, or any suitable sub-range thereof. In another embodiment, ridges 118 extend outwardly from surface 106 about 0.01 inch, about 0.02 inch, about 0.03 inch, about 0.04 inch, about 0.05 inch, about 0.06 inch, about 0.07 inch, about 0.08 inch, about 0.09 inch, about 0.1 inch, or any suitable sub-range thereof.

In one embodiment, the distance between adjacent ridges 118 is between about 0.01 inch and about 0.02 inch, between about 0.01 inch and about 0.03 inch, between about 0.01 inch and about 0.04 inch, between about 0.01 inch and about 0.05 inch, between about 0.01 inch and about 0.06 inch, between about 0.01 inch and about 0.07 inch, between about 0.01 inch and about 0.08 inch, between about 0.01 inch and about 0.09 inch, between about 0.01 inch and about 0.1 inch, between about 0.02 inch and about 0.03 inch, between about 0.02 inch and about 0.04 inch, between about 0.02 inch and about 0.05 inch, between about 0.02 inch and about 0.06 inch, between about 0.02 inch and about 0.07 inch, between about 0.02 inch and about 0.08 inch, between about 0.02 inch and about 0.09 inch, between about 0.02 inch and about 0.1 inch, between about 0.03 inch and about 0.04 inch, between about 0.03 inch and about 0.05 inch, between about 0.03 inch and about 0.06 inch, between about 0.03 inch and about 0.07 inch, between about 0.03 inch and about 0.08 inch, between about 0.03 inch and about 0.09 inch, between about 0.03 inch and about 0.1 inch, between about 0.04 inch and about 0.05 inch, between about 0.04 inch and about 0.06 inch, between about 0.04 inch and about 0.07 inch, between about 0.04 inch and about 0.08 inch, between about 0.04 inch and about 0.09 inch, between about 0.04 inch and about 0.1 inch, between about 0.05 inch and about 0.06 inch, between about 0.05 inch and about 0.07 inch, between about 0.05 inch and about 0.08 inch, between about 0.05 inch and about 0.09 inch, between about 0.05 inch and about 0.1 inch, between about 0.06 inch and about 0.07 inch, between about 0.06 inch and about 0.08 inch, between about 0.06 inch and about 0.09 inch, between about 0.06 inch and about 0.1 inch, between about 0.07 inch and about 0.08 inch, between about 0.07 inch and about 0.09 inch, between about 0.07 inch and about 0.1 inch, between about 0.08 inch and about 0.09 inch, between about 0.08 inch and about 0.1 inch, between about 0.09 inch and about 0.1 inch, or any suitable sub-range thereof. In another embodiment, the magnitude of distances between adjacent ridges 118 is about 0.01 inch, about 0.02 inch, about 0.03 inch, about 0.04 inch, about 0.05 inch, about 0.06 inch, about 0.07 inch, about 0.08 inch, about 0.09 inch, about 0.1 inch, or any suitable sub-range thereof.

It is to be understood that any ranges/sub-ranges of distances of ridges 118 extending outwardly from surface 106 can be utilized in combination with any ranges/sub-ranges of distances between adjacent ridges 118.

Figure 16:
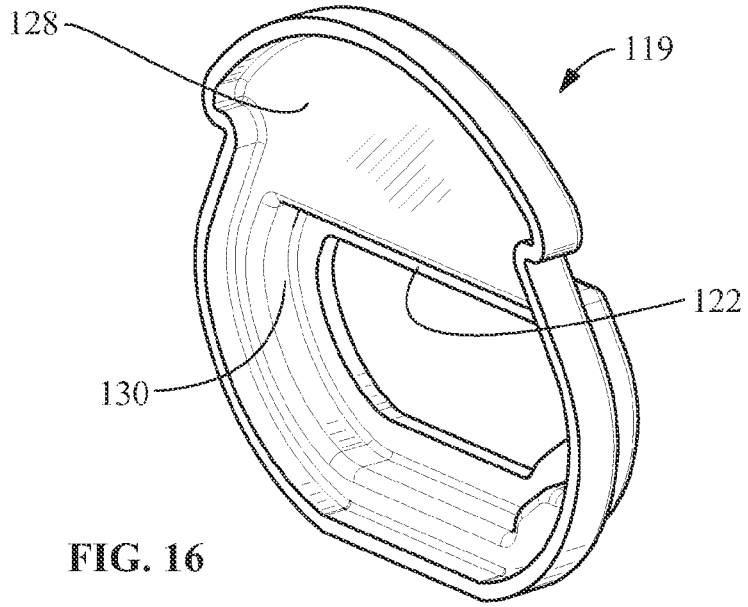
FIG. 16 is a perspective view of an exemplary embodiment of a distributor baffle/seal for use with the inlet header.
Figure 17:
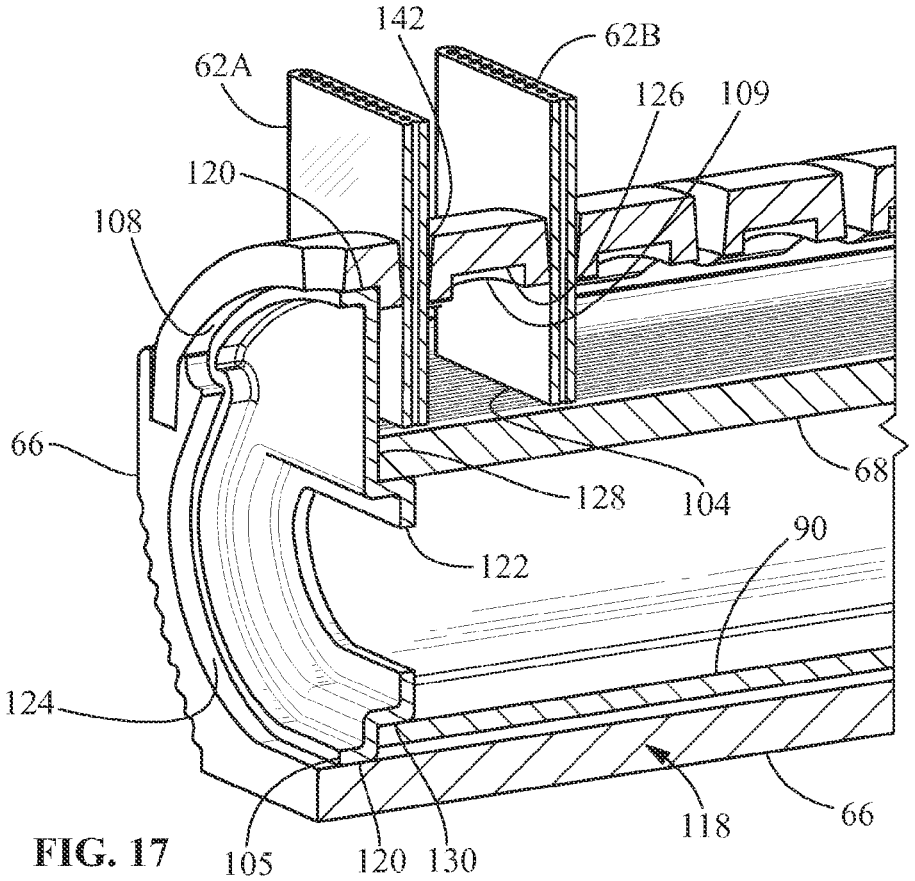
FIG. 17 is a cutaway view of the inlet header with the distributor baffle/seal installed.

It is to be understood that chambers 84, 86, 88 be sealed off or isolated from one another, as shown in FIGS. 16-17. In other words, for proper operation of the system, refrigerant 70 (which includes liquid refrigerant 71) received by inlet header 66 and ultimately discharged into refrigerant tubes 62 entails flow of refrigerant 70 serially through respective chambers 84, 86, 88. That is, it is important that chambers 84, 86, 88 be sealed in a manner ensuring that flow of refrigerant 70 in a sequence other that from chamber 84 to chamber 86 and then to chamber 88 is prevented. As further shown in FIGS. 16-17, a baffle/seal 119 includes a body 128 extending outwardly to a peripheral or outer flange 120 configured to be sealingly received by inner surfaces 124, 126 of inlet header 66. As further shown in FIG. 17, body 128 of baffle/seal 119 further includes an offset region 130, in which body 128 offset region 130 are configured to abut both end 105 and inner surface 90 of distributor tube 68 (FIGS. 11, 14). As further shown in FIGS. 16-17, offset region 130 transitions to an inner flange 122 and has an aperture 132. As further shown in FIG. 17, aperture 132 is sized to be substantially smaller and positioned toward the bottom or lower portion of distributor tube 68 to serve as a liquid baffle and/or to serve as an orifice to improve refrigerant injection into distributor tube 68. In another embodiment, inner flange 122 can be minimized to maximize the cross sectional area flowing into distributor tube 68. Distributor baffle/seal 119 is typically integrally brazed in place, with all contact points between distributor baffle/seal 119 and corresponding inner surfaces 124, 126 of inlet header and end 105 of distributor tube 68 being brazed to create fluid tight seal.

Other techniques of sealing off chambers 84, 86, 88 can include welding, stamping or other suitable methods or apparatus. Inlet header 66 is shown in FIG. 17 as a cutaway, with baffle/seal 119 installed. In this configuration, baffle seal 119 is placed between refrigerant tube 62A and refrigerant tube 62B, when refrigerant tube 62A is inactive or a solid tube. In other embodiments, baffle/seal 119 can be placed in front of refrigerant tube 62A, when desired.

Figure 15:
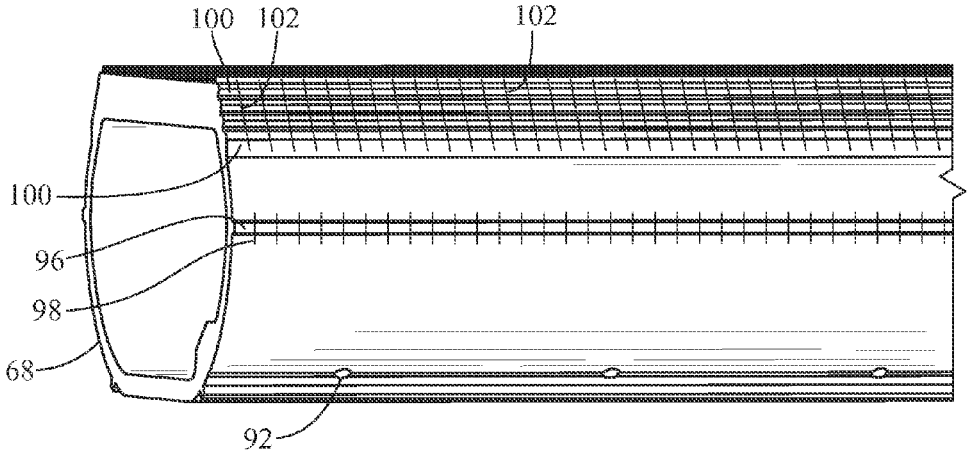
FIG. 15 is a partially rotated side view of the distributor FIG. 13

In one embodiment, as shown in FIGS. 13-15, opening(s) 98, 102 can be mutually aligned with each other. In one embodiment, openings 98, 102 can be at least partially misaligned from each other. In one embodiment, one or more of openings 98, 102 can be of similar cross sectional area and/or shape. In one embodiment, one or more of openings 98, 102 can be of dissimilar cross sectional area and/or shape.

Figure 8:
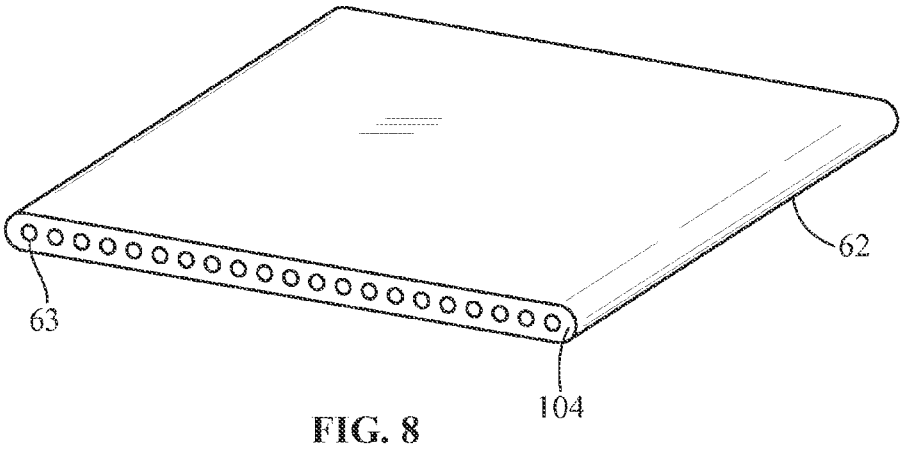
FIG. 8 is a perspective view of an exemplary multiport tube of the heat exchanger.
Figure 9:
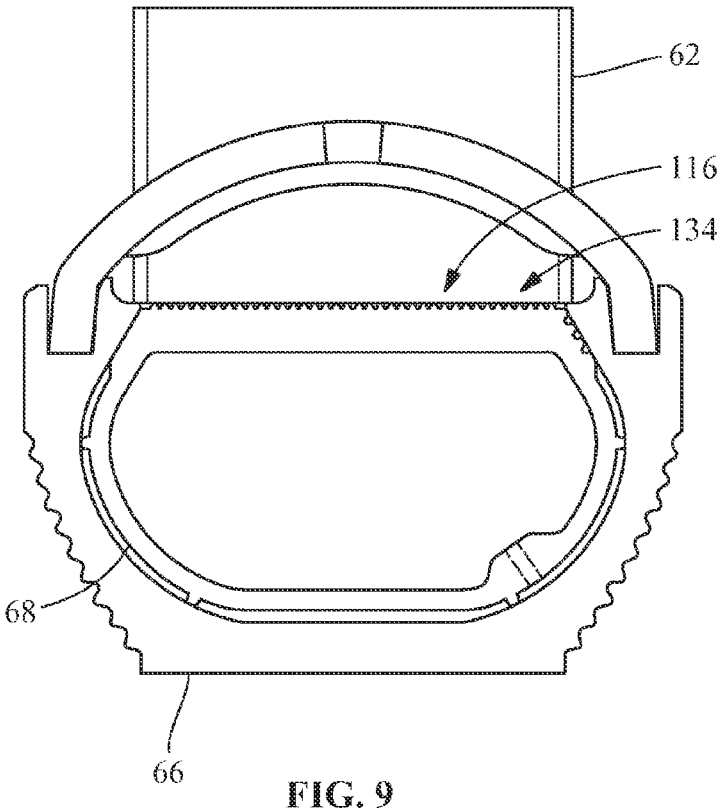
FIG. 9 is an end view of an inlet header.

Another characteristic of this invention is that injection of two phase refrigerant 70 into chamber 88 (FIG. 11) occurs between every Microchannel (multiport) or refrigerant tube 62. In addition, openings 63 (FIG. 8) formed in each of the multitude of Microchannel or refrigerant tubes 62 associated with end 104 of refrigerant tubes 62 is positioned in close proximity to surface features 116, such as a plurality of ridges 118 separated from each other by a region 121 such as a recess or trough. A region or trough 121 is aligned with each opening 63 of each Microchannel or refrigerant 62, with a corresponding pair of ridges 118 positioned along each side of an opening 63 of a Microchannel or refrigerant tube 62, such that an interface 134 (FIG. 11) with the multiports or openings 63 of the Microchannel or refrigerant tubes 62 and ridges 118 and troughs 121 formed in surface 106 (FIG. 11) of distributor tube 68 create secondary chambers 136 (FIG. 11) with every opening 63 (FIG. 8). This interface 134 substantially isolates each secondary chamber 136 from one another, sufficiently, that liquid and/or gas refrigerant 70 migration along the length of inlet header 66 (from opening 63 to opening 63 of refrigerant tube 62) is contained, but not eliminated.

Figure 22:
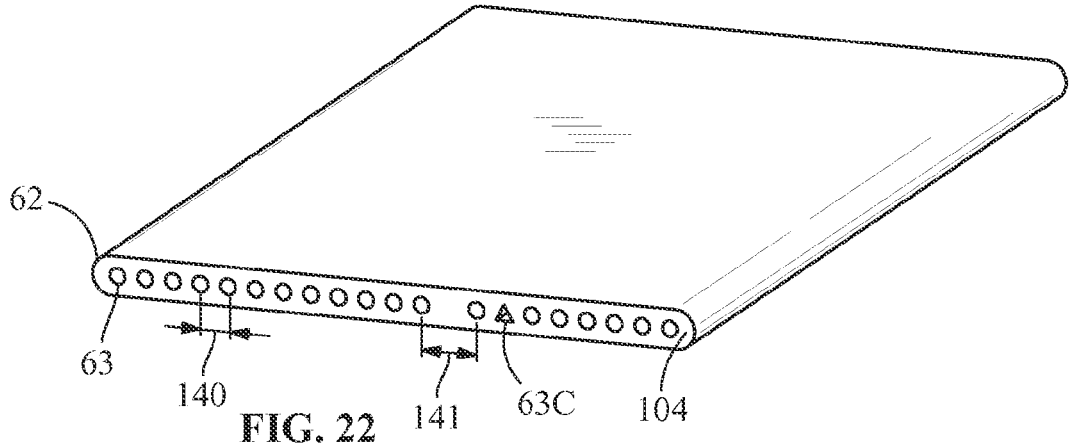
FIG. 22 is a partially rotated end view of an exemplary embodiment of a refrigerant tube.
Figure 24:
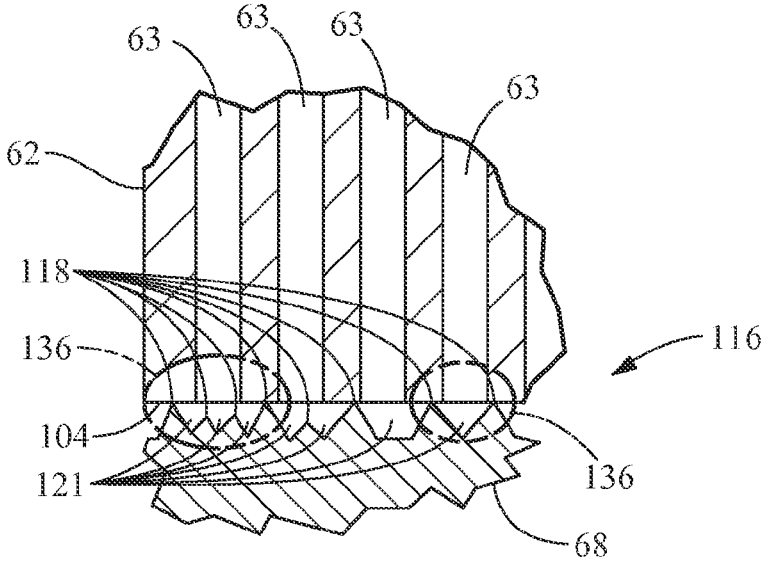
FIG. 24 is an enlarged, partial cutaway view between an exemplary refrigerant tube and distributor.

This feature of restricting refrigerant 70 migration among tube openings 63 of the Microchannel or refrigerant tubes 62 is important to maintaining substantially equal refrigerant injection into the tube openings 63. This feature also counteracts the effects of outlet manifold pressure drop and random instabilities in refrigerant boiling in the openings 63 of the Microchannel tubes 62, which also can induce significant refrigerant mal-distribution, and loss of heat exchanger thermal performance. In one embodiment, troughs 121 are similar, e.g., can have substantially similar depths and/or shapes or profiles relative to one another. In one embodiment, at least two troughs 121 are different, e.g., can have dissimilar depths or shapes or profiles relative to one another. In one embodiment, the depths and/or widths and/or shapes or profiles of troughs 121 can be different from other troughs 121, (see FIG. 24) so long as a pair of ridges 118 is positioned to each side of each opening 63 for establishing a secondary chamber 136 therebetween. In one embodiment, at least one pair of ridges 118 for a corresponding distributor tube opening 63 are adjacent to each other. In one embodiment, at least one region between a pair of ridges 118 is different than another region between another pair of ridges 118. In one embodiment, such as shown in FIG. 22, spacing 140 between adjacent openings 63 can be different than at least one other spacing between adjacent openings 63, such as spacing 141. In another embodiment, the geometric shape of openings 63 can be different from each other, such as opening 63C. However, in order to achieve maximum operating efficiency, each opening 63 must form a secondary chamber 136, i.e., have protruding surface features 116, such as ridges 118 positioned to each side of each opening 63, as previously discussed and as shown in FIG. 24.

Figure 23:
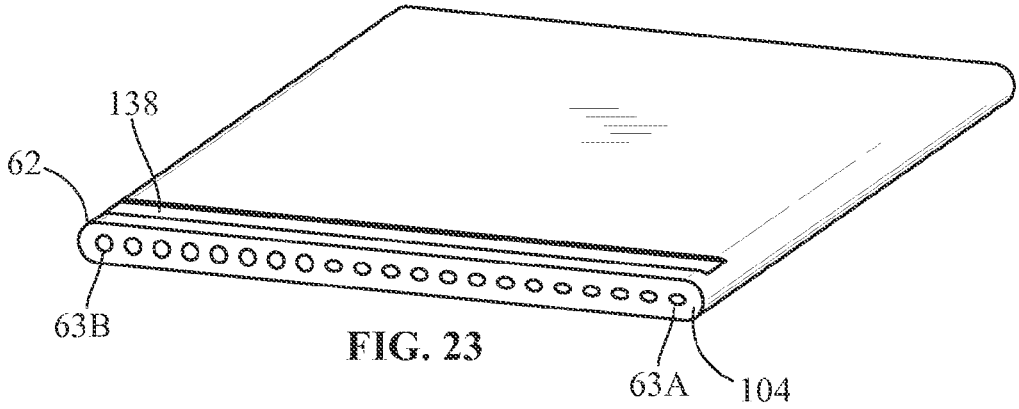
FIG. 23 is a partially rotated end view of an exemplary embodiment of a refrigerant tube.

Another characteristic of the heat exchanger of this disclosure is that the ports or openings 63 in Microchannel or refrigerant tube 62 are properly sized for optimum refrigerant boiling and velocities. Another related option for improved performance is to use a Microchannel or refrigerant tube 62 with port or opening 63 sizes that are different from each other, such as openings 63 which gradually increase across the width of the tube 62, such as shown in FIG. 23. This selective pinched port arrangement allows more refrigerant to enter into select ports or openings 63 such that thermal performance is again improved. The port or opening 63 size can be changed or induced by introducing a varied depth indentation 138 (pinch) formed in the inlet side of the Microchannel or refrigerant tube 62 (FIG. 23 versus non-indented tube FIG. 22) that forms an interface 134 (FIG. 11) with surface 106 of distributor tube 68. As shown in FIG. 23, port opening 63 sizes can be pinched down (restricted) to about 20 percent of the original opening 63 on a first port or opening 63A and gradually less pinched (restricted) to about 100 percent of the original opening on a last tube port or opening 63B. In one embodiment, port or opening 63 sizes can vary in a non-uniform and/or non-gradual manner, if desirable.

The heat exchanger of the disclosure accommodates a range of refrigerant pressure drops in the Microchannel multiport or refrigerant tube 62 which can affect refrigerant distribution, whether low or moderately high pressure drop. The heat exchanger of the disclosure also utilizes or accommodates low and medium pressure drops in the outlet header 64 (FIG. 5), which can also have a significant effect and influence on the distribution of refrigerant entering the multiport or refrigerant tubes 62 at full load and at part load. Pressure drop across the outlet manifold header 64, in combination with refrigerant tube 62 pressure drops, can induce mal-distribution of refrigerant entering the multiport or refrigerant tubes 62. Thus, secondary chambers 136 and opening(s) 102 (FIG. 15), with the optimum pressure drop, counteracts the inlet header 68 and refrigerant tube 62 combination pressure drops, and will substantially correct or minimize refrigerant mal-distribution, in which mal-distribution creates a loss of thermal performance and capacity, as viewed and regulated by the control valve to maintain a target refrigerant superheat temperature or pressure.

In practice, overall, and as shown in FIGS. 11 and 14-15, when the heat exchanger of this disclosure is used as an evaporator, the heat exchanger is used to induce a low to high pressure drop through a first set of orifices 92 to provide substantially uniform refrigerant distribution from distributor tube 68 (chamber 84), and upon entering chamber 86, then use a second set of low pressure drop openings 98 to propel and further improve refrigerant 70 distribution, and a third set of openings 102 to inject in a third refrigerant 70 into final chamber 88 at low or high pressure drop, whereby the two phase refrigerant 70 can be substantially equally injected and isolated to enter each individual opening 63 of refrigerant tube 62.

Figure 1:
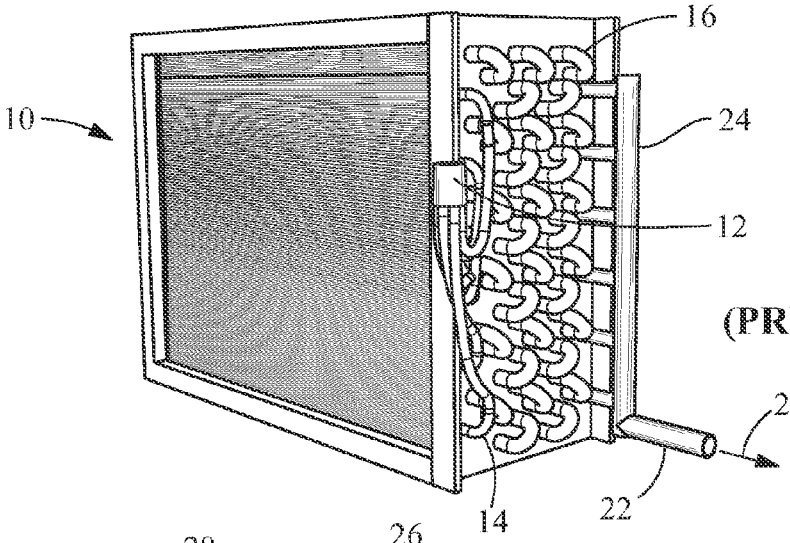
FIG. 1 (PRIOR ART)
FIG. 1 is a conventional heat exchanger having a fin and tube coils.
Figure 2:
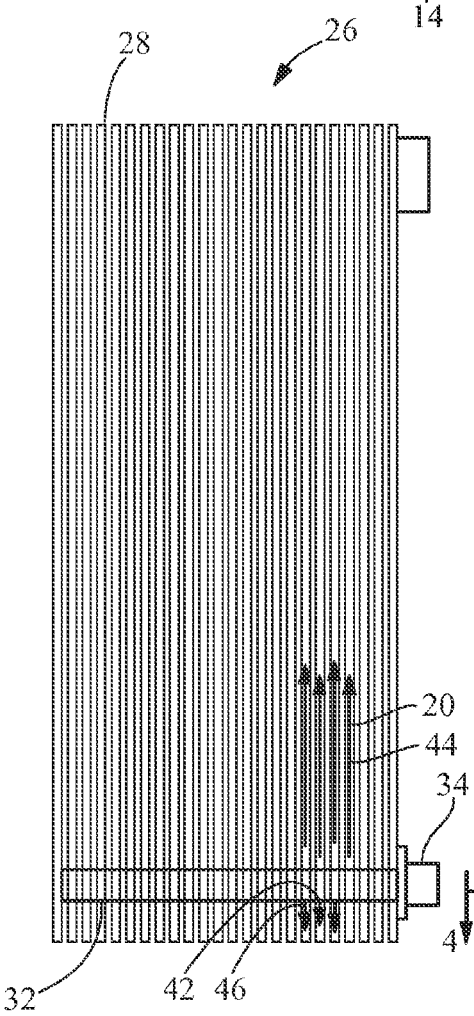
FIG. 2 (PRIOR ART)
FIGS. 2 and 3 are different views of a conventional plate heat exchanger.
Figure 3:
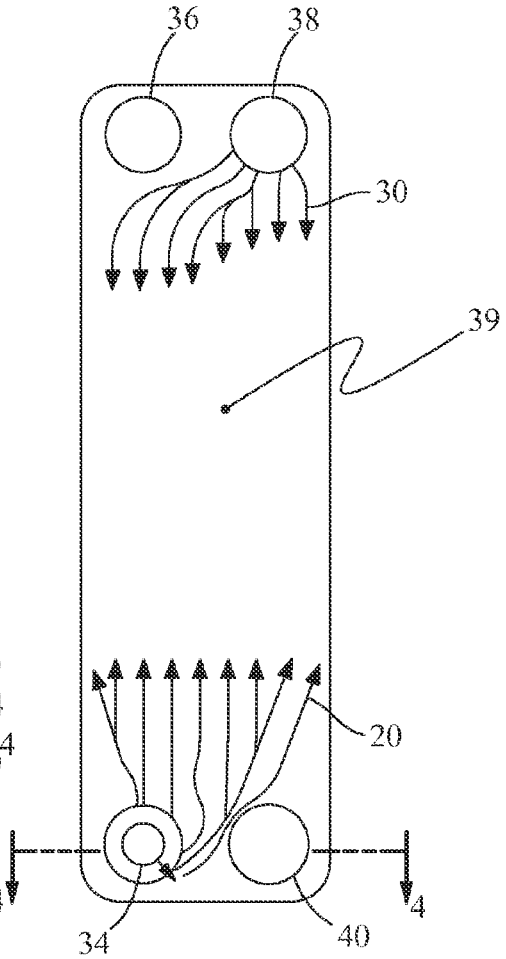
FIG. 3 (PRIOR ART)
Figure 4:
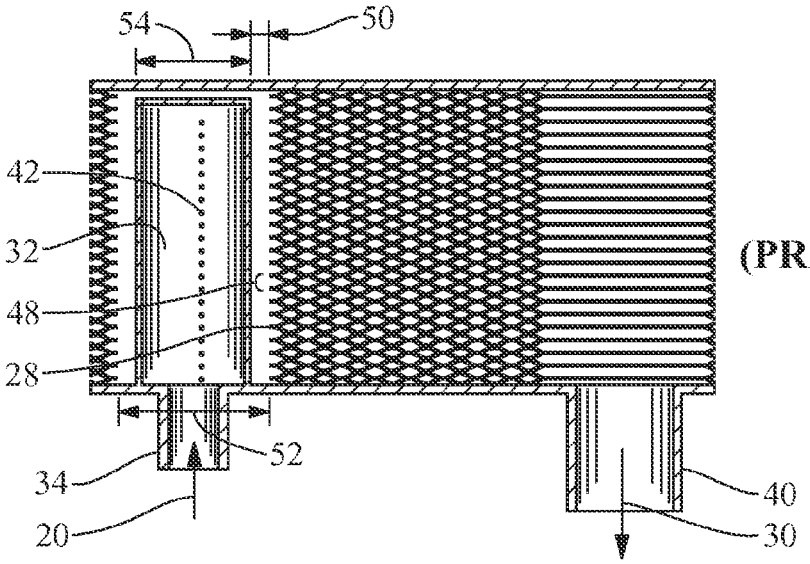
FIG. 4 (PRIOR ART)
FIG. 4 is a cross section taken of the plate heat exchanger taken along line 4-4 of FIG. 3.
Figure 5:
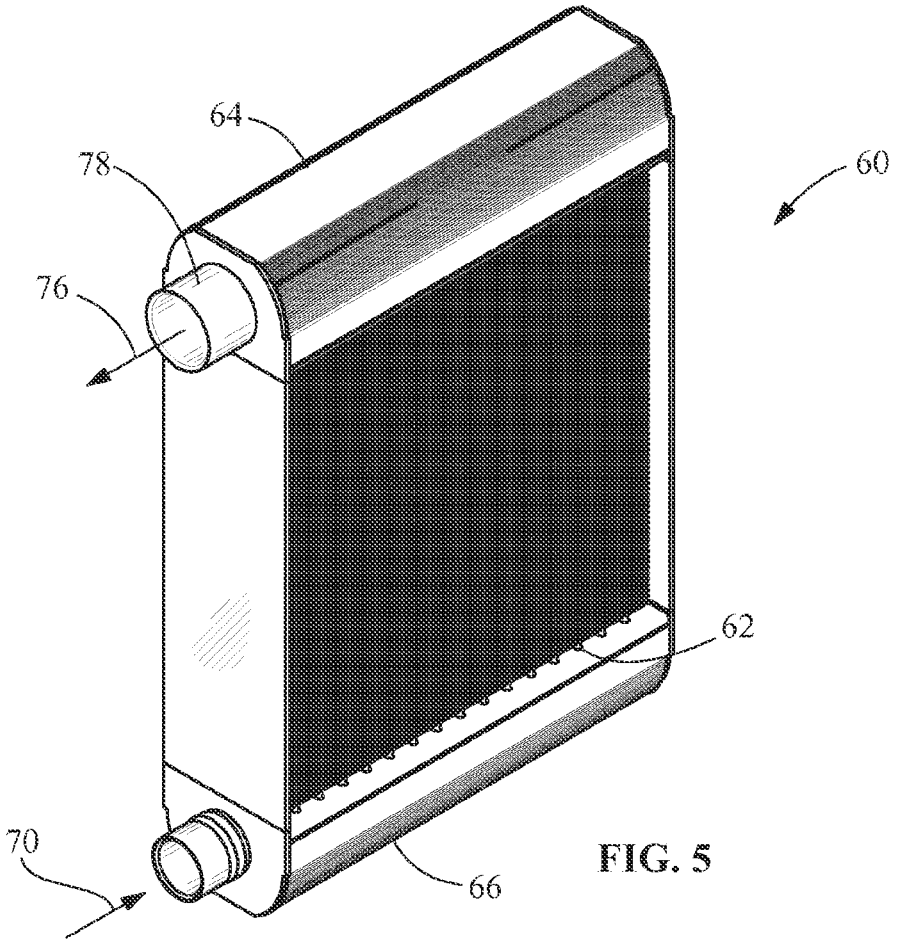
FIG. 5 is a perspective view of an exemplary heat exchanger.
Figure 6:
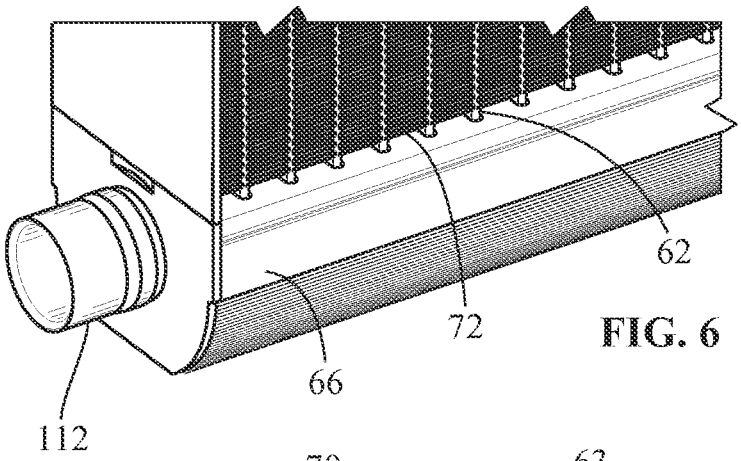
FIG. 6 is an enlarged partial perspective view of the heat exchanger of FIG. 5.

In practice, when the heat exchanger is used as a condenser reversing refrigerant flow directions as shown in FIGS. 5 and 11 and as discussed below, refrigerant enters the upper manifold header 64 and then condensed inside the refrigerant tubes 62, liquid refrigerant 71 flows in reverse direction through all three chambers 88, 86, 84 and exits the lower manifold header 66. All three chambers 84, 86, 88 can be optimized for minimal liquid refrigerant pressure drop, and the lower manifold header 66 can hold a small amount of liquid refrigerant 71 and serve as a mini-receiver, as described in Applicant's co-pending application Ser. No. 12/691,920, which is incorporated by reference in its entirety. An optional refrigerant liquid baffle as described in the application can be used to add the mini-receiver feature to the distributor or heat exchanger.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claim.

What is claimed is:

1. A heat exchanger for use with a two-phase refrigerant, comprising:

an inlet header;

an outlet header spaced from the inlet header;

a plurality of refrigerant tubes hydraulically connecting the inlet header to the outlet header;

a distributor tube, having a plurality of orifices, disposed in the inlet header, the end of the refrigerant tubes opposite the outlet header extending inside the inlet header and abutting a surface of the distributor tube, a portion of an inner surface of the inlet header receiving the tubes and facing the surface of the distributor tube, and the surface of the distributor tube, defining a first chamber;

a gap of between about 0.01 inch and about 0.3 inch separating at least a portion of the distributor tube and the inlet header, the gap extending from at least the orifices to the first chamber, wherein at least one partition having at least one opening formed therethrough spanning the gap, the partition separating the orifices from the first chamber.

2. The heat exchanger of claim 1, wherein the plurality of orifices being generally oriented vertically above pooled liquid refrigerant collecting in the distributor tube when the refrigerant tubes are oriented between a horizontal position and a vertical position, creating a weir effect such that liquid refrigerant flow is substantially uniform through the orifices and into the gap.

3. The heat exchanger of claim 1, wherein the cross sectional area of each orifice of the plurality of orifices is between about 0.0003 $in^2$ and about 0.03 $in^2$.

4. The heat exchanger of claim 1, wherein the plurality of orifices are positioned between about 150 degrees and about 180 degrees relative to an axis substantially coincident to a flow direction of refrigerant through the plurality of refrigerant tubes.

5. The heat exchanger of claim 4, wherein the plurality of orifices are in substantial alignment relative to a plane coincident with an axis extending along the longitudinal length of the distributor tube and coincident to a flow direction of refrigerant through the plurality of refrigerant tubes.

6. The heat exchanger of claim 4, wherein the plurality of orifices extend through an outwardly extending region from an inner surface of the distributor tube.

7. The heat exchanger of claim 6, wherein the plurality of orifices being generally oriented vertically above pooled liquid refrigerant collecting in the distributor tube when the refrigerant tubes are oriented between a horizontal position and a vertical position, creating a weir effect such that liquid refrigerant flow is substantially uniform through the orifices and into the gap.

8. The heat exchanger of claim 1, wherein between the distributor tube and the inlet header, refrigerant flow is prevented between the plurality of orifices and the first chamber in a direction opposite the plurality of orifices toward the at least one opening.

9. The heat exchanger of claim 1, wherein a ratio of the cross sectional area defined by an inner surface of the distributor tube to a cross sectional area of an inlet connection with the inlet header is greater than about 5:1.

10. The heat exchanger of claim 1, wherein a ratio of the cross sectional area defined by an inner surface of the distributor tube to a cross sectional area of an inlet connection with the inlet header is between about 1:1 and about 5:1.

11. The heat exchanger of claim 1, wherein a ratio of the cross sectional area defined by an inner surface of the distributor tube to a cross sectional area of an inlet connection with the inlet header is between about 2:1 and about 5:1.

12. The heat exchanger of claim 1, wherein a ratio of the cross sectional area defined by an inner surface of the distributor tube to a cross sectional area of an inlet connection with the inlet header is between about 3:1 and about 5:1.

13. The heat exchanger of claim 1, wherein a ratio of the cross sectional area defined by an inner surface of the distributor tube to a cross sectional area of an inlet connection with the inlet header is between about 4:1 and about 5:1.

14. A heat exchanger for use with a two-phase refrigerant, comprising:

an inlet header;

an outlet header spaced from the inlet header;

a plurality of refrigerant tubes hydraulically connecting the inlet header to the outlet header;

a distributor tube, having a plurality of orifices, disposed in the inlet header, the end of the refrigerant tubes opposite the outlet header extending inside the inlet header and abutting a surface of the distributor tube, a portion of an inner surface of the inlet header receiving the tubes and facing the surface of the distributor tube, and the surface of the distributor tube, defining a first chamber;

the surface of the distributor tube having surface features for holding and capturing refrigerant liquid such that each opening formed in the refrigerant tubes forming a secondary chamber therewith;

a gap of between about 0.01 inch and about 0.3 inch separating at least a portion of the distributor tube and the inlet header, the gap extending from at least the orifices to the first chamber, wherein at least one partition having at least one opening formed therethrough spanning the gap, the partition separating the orifices from the first chamber.

15. The heat exchanger of claim 14, wherein the surface features comprising a plurality of ridges, each opening formed in the refrigerator tubes corresponding to a pair of ridges, a ridge of the pair of ridges positioned along each side of each opening for forming the secondary chamber therewith.

16. The heat exchanger of claim 15, wherein at least one pair of ridges for a corresponding distributor tube opening are adjacent to each other.

17. The heat exchanger of claim 15, wherein at least one region between the pair of ridges is different than another region between another of the pair of ridges.

18. The heat exchanger of claim 14, wherein at least a portion of at least one refrigerant tube opening has a different cross sectional area than another refrigerant tube opening.

19. The heat exchanger of claim 14, wherein the plurality of orifices being generally oriented vertically above pooled liquid refrigerant collecting in the distributor tube when the refrigerant tubes are oriented between a horizontal position and a vertical position, creating a weir effect such that liquid refrigerant flow is substantially uniform through the orifices and into the gap.

20. The heat exchanger of claim 14, wherein the cross sectional area of each orifice of the plurality of orifices is between about 0.0003 $in^2$ and about 0.03 $in^2$.

* * * * *